United States Patent [19]

Hellwig

[11] Patent Number: 4,592,589

[45] Date of Patent: Jun. 3, 1986

[54] INFLATABLE-INFLATED CUSHION FOR SEAT

[76] Inventor: Klaus D. Hellwig, Brunnader Strasse 7, D-8345 Birnbach, Fed. Rep. of Germany

[21] Appl. No.: 709,989

[22] Filed: Mar. 11, 1985

Related U.S. Application Data

[63] Continuation-in-part of Ser. No. 679,958, Dec. 10, 1984.

[30] Foreign Application Priority Data

Dec. 14, 1983 [DE] Fed. Rep. of Germany ..... 3345291

[51] Int. Cl.[4] ..... A47C 3/00

[52] U.S. Cl. ..... 297/284; 297/458; 297/DIG. 3

[58] Field of Search ..... 297/DIG. 3, 284, 458, 297/459, 219

[56] References Cited

U.S. PATENT DOCUMENTS

| | | | |
|---|---|---|---|
| 202,925 | 4/1878 | Brown | 297/459 |
| 1,673,636 | 6/1928 | Perry | 297/DIG. 3 |
| 1,823,569 | 9/1931 | Mellano | 297/DIG. 3 |
| 3,115,647 | 12/1963 | Emery | 297/DIG. 3 |
| 3,296,635 | 1/1967 | O'Hanlan | 297/DIG. 3 |
| 3,652,126 | 3/1972 | Folling | 297/DIG. 3 |
| 3,680,917 | 8/1972 | Harris | 297/DIG. 3 |
| 4,059,909 | 11/1977 | Kron | 297/DIG. 3 |

*Primary Examiner*—Francis K. Zugel

*Attorney, Agent, or Firm*—Jordan and Hamburg

[57] ABSTRACT

Inflatable or inflated seat cushion intended as a training or helping device mainly for sitting upright without a back rest providing as in walking for extensive free play of movement especially in the region of the pelvis and the lumbar, which activates the erecting muscular system and avoids permanent stress. The seat cushion is made of flexible material of several adjacently-arranged communicating chambers which are divided by a groove, whereby the height of the chambers decreases from the back towards the front.

1 Claim, 6 Drawing Figures

INFLATABLE-INFLATED CUSHION FOR SEAT

This application is a continuation-in-part, of application Ser. No. 679,958, filed Dec. 10, 1984.

The invention relates to an inflatable or inflated seat cushion made of a flexible material having several (particularly two) adjacent chambers which communicate with one another.

The seat cushion is intended to serve as an exercising device and aid, especially during upright sitting without a backrest, in order to achieve a favorable physiological lumbar lordosis, and to make possible extensive free play of motion, as possible in upright walking, mainly in the region of the pelvis and the lumbar. This activates the supporting muscular system into stabilizing the labile equilibrium, because of the increased lability, however, which thereby avoids harmful permanent stress by facilitating changes of position.

In contrast to even the newer developments of sitting devices of dynamic sitting comfort, having as their main aim a passive support and reduction of the stress of the supporting muscular system (with its consequently resulting weakening thereof), the seat cushion according to the invention, in a simple and inexpensive way, allows action against widespread weaknesses of posture and the resulting posture damage which frequently occurs in conventional sitting, even in a work situation.

The invention proceeds from the fact that inflatable seat cushions of the most varied kind and configuration are already known which, notwithstanding the material-induced padded form of their chambers, usually favor flat seating surfaces positioned parallel to the support. The important feature of these cushions is that they provide a padding with respect to a hard support and a protective shielding agaist humid and/or cold support surfaces of the seat. The object of the invention, however, is directed towards a configuration of a seat cushion designed according to medical and orthopedic points of view in order to prevent and treat posture weaknesses and posture damage, whereby essential novel connections, which so far have remained unnoticed in the appropriate scientific examinations, are taken into consideration. The point of departure of the considerations is the fact that after extensive walking, there occurs none of the manifestations of fatigue as commonly experienced after a relatively short time of ordinary sitting, which requires supporting the vertebral column in order to relieve it. In the analysis of the rhythmically occurring walking process, it has been shown that the stabilization of the labile position of equilibrium can be achieved without great expenditures of energy by shifting the center of gravity by means of compensating movements in the lower pelvis and lumbar region. Because of the extensive stiff fixation in conventional sitting, usually this relieving play of movement is considerably limited, and forces "unnatural" movement patterns, incorrect posture and results in incorrect stress load. Painful straining in the region of the shoulder, neck, lumbar, pelvis and hips, with damage to the muscular and ligament system, leading to structural damage, occurs relatively early, resulting, in the long term, in vertebral column and joint damage.

The object of the invention is to extensively eliminate the harmful consequences of conventional sitting by means of a special inflatable seat cushion which furthers especially free movement processes in the region of the lower pelvis and lumbar, which normally serve for the stabilization of the labile position of equilibrium during walking. In order to achieve this, in addition to providing a very mobile form (non-rigid air cushion) of the sitting device, it is also necessary to bring the pelvis into the correct initial position of rest. The thus-assumed position favors the natural upright position of the vertebral column which, among others, is characterized by a slight forward curvature of the spine in the lumbar region (physiological lumbar lordosis). Only after assuming this healthy sitting position is it possible that breathing can occur unhindered, which results in better diaphragm function with free unfolding of the rib and lung sections.

In order to solve the problem, the invention of the seat cushion of the initially-mentioned kind provides that the height of the chambers decreases from the back towards the front. In its optimal configuration, this results in a slanting surface as a tangential plane which forms, with the horizontal plane, an angle of inclination of 20 to 30 degrees in a seat cushion filled to maximum. The length of the seat cushion should be greater than twice the spacing of a person's seat protuberances. However, it should not exceed the maximum diameter of the pelvis from a frontal view. The width (z+v in FIG. 2) of the seat cushion also should not exceed this value in order to facilitate dorsal and ventral tilting and shifting movements between the indicated limit ranges. This results in that relatively small seat cushions should be used for children.

According to the simplest and most useful solution, the division into two adjacently arranged chambers with a corresponding groove between these chambers, first of all, forces the user of this cushion to sit down in such a way that the person's sitting protuberances of the pelvic bones become located in the area of the groove between the two adjacent chambers. The raised rear chamber favors the desired pelvic position. Besides its function as a guideline for the person's sitting protuberances, in this configuration the groove also serves as a suitable rotation area which, in contrast to stiff seating surfaces, allows unhindered and without great expenditure of energy, tilting, erecting, and bending to the sides of the pelvis, as well as changes of location of the vertebral column and the shifting of the center of gravity connected with it. Because of the deformability of the seat cushion, which also depends on the degree of fullness, limited parallel shifts of the seating surface against the support surface are possible in all directions, whereby the play of movement is further increased. The ability to make parallel shifts can be increased by means of making the chamber higher and/or increasing the height of the crosspiece for the groove, whereby it is possible to provide for several diagonal openings which increase lateral shiftability. The movement possibilities mentioned above can be further increased, if two superimposed chamber systems are used whereby air does not go from one to another, however, whereby the two systems of similar construction are connected to each other, i.e., in the simplest form by means of positioning two seat cushions according to the invention on top of one another, whereby their size relationships are adjusted in an individual configuration of the double total height according to the same basic principle. In this connection, the possibility of various filling levels of the two chamber systems is also of importance.

Because of the free play of movement in the region of the pelvis and the lumbar of the initial position of rest, stress can be permanently shifted, as occurs during upright walking, so that damaging permanent stress and its related manifestations of fatigue do not occur which, in ordinary sitting, usually make it necessary to support the back. Of course, back support need not be given up, even though it is no longer of main importance because of the connected training of the muscular system of the vertebral column or the torso. Because of the continuous shifting of the stress points taking place by means of minimum movement impulses, the thereby-occurring suction and pumping effect increases blood circulation and metabolism in the interarticular disk tissue and thus acts against degenerative interarticular disk changes.

In reference to the extent of movement and the ease of executing movement impulses, the play of movement achieved with the seat cushion according to the invention is greater than that achieved during walking. The corresponding greater lability of the point of gravity during sitting has further advantages. Already at a slight deviation from the labile position of equilibrium, there occur prompt counter impulses for avoiding tipping over which, again, produce the ideal initial position, at a low expenditure of energy, thus avoiding an extended position in a bad or unfavorable posture, as it regularly occurs in conventional sitting on stiff seating surfaces, and even with the up-to-now-developed or used seat cushions. An existing incorrect immobility or diseased curvature of the vertebral column is consequently acted against by means of the seat cushion according to the invention. It avoids great leverage of harmful compression and gravity effects between the vertebrae and instills permanently favorable movement patterns. Posture weaknesses are thus decreased by the constant exercise of the entire support muscular system in the area of the pelvis and the vertebral column, including the abdominal muscles, by means of the activity during sitting. It is of importance that entire movement chains are simultaneously being activated. Slight structural interferences of the vertebral column and eventually connected functional interferences in the area of the chest and abdomen can be reduced or, in a given case, completely eliminated, by repeated unblocking impulses which seize the vertebral column as a unit.

Painful states of tension in the areas of the hip, pelvis, lumbar, shoulder and neck are self-actingly and highly effectively avoided by means of delicate and low-stress movement and loosening-up impulses. Thus, the seat cushion according to the invention can greatly contribute to the prevention and treatment of damage to the vertebral column and joints resulting from repeated incorrect stress and forced positions in the conventional sitting position, which favors unnatural and damaging movement processes, because of the stiff fixation of the pelvis.

It is not possible to attain such favorable results with conventional seat cushions manufactured up to now which are not intended for the purpose of improving posture and for preventing damage to the vertebral column. Because of the inclination to assume an incorrect posture when using them, there are triggered distortions and faulty movement processes which, under certain circumstances, due to increased movability, could lead to increased joint disturbances of the vertebral column. Only a seat adapted to a healthy posture and to natural movement processes provides the prerequisite for preventing and treating vertebral column damage due to incorrect posture during sitting.

In a further embodiment of the invention, not only the chamber height, but also the chamber width decreases from the back towards the front, whereby two or more chambers are arranged adjacent to each other, forming the seat cushion. The slanting of the seating surface always guides the user into the desired ideal sitting position, whereby the person's sitting protuberances are located in the groove between two adjacent chambers. The two-chamber version with a favorable rotation area and immediate redistribution of the air filling in the two chambers at a shift of the center of gravity provides also a maximum of freedom of movement in the desired direction.

It is in the scope of the invention to provide an arrangement so that the chambers are parallel and next to each other. Another alternative provides that the chambers are arranged around each other with a forward pointing U-opening and that their cross-sectional diameter decreases towards the front. In the latter case, the play of movement of the lower region of the pelvis is reduced, and especially the laterally-directed movement impulses receive thereby a centering towards the middle.

A further embodiment of the invention is characterized in that two or more individual seat cushions are arranged one on top of the other and are connected to each other, but the inner fluid chambers do not communicate with one another. These individual cushions are constructed in principle like the seat cushion but are arranged one on top of another. The solution of the combination follows the same desired principle, whereby it is also possible to make corresponding changes, especially with regard to the total height.

In another embodiment of the invention, the seal cushion can also be considered not as a loose, independent object, but as an integrated component of an item of furniture, to which it is associated as a loose pillow layer which can either be fixedly or detachably connected to it. The basic principle of the invention, however, does not change.

Further characteristics, features and advantages of the invention result from the following description of a few preferred embodiments of the invention, as well as from the drawings which follow

DESCRIPTION OF THE PREFERRED EMBODIMENTS

Figure 1:
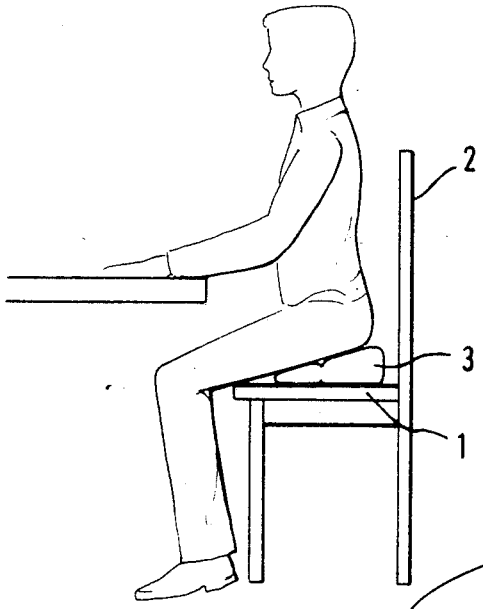
FIG. 1 is a side view showing the desired sitting position represented in simplified form.

FIG. 1 shows the desired sitting position with the help of the seat cushion 3, according to the invention, lying on the seat 1 of the chair 2.

Figure 2:
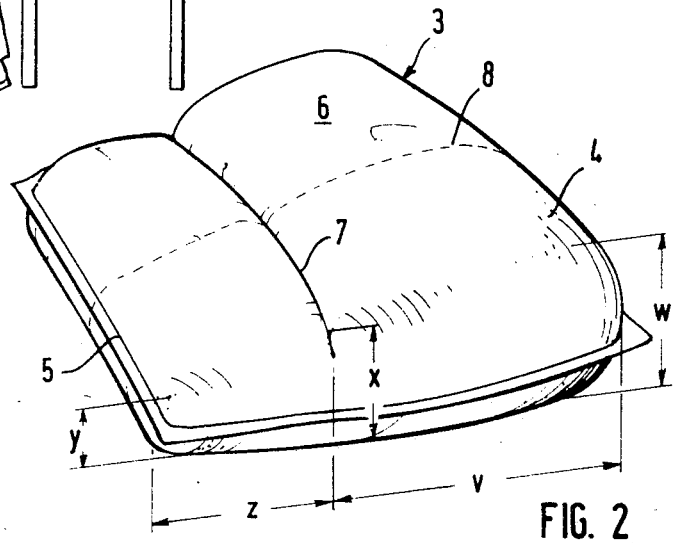
FIG. 2 is a perspective view of a first embodiment

This seat cushion 3, according to the embodiment of FIG. 2, comprises two chambers 4 and 5 which communicate with one another and a conventional valve for inflating the cushion by means of a gas or generally air. The varying filling levels of the two chambers 4 and 5 influence the extent of movement play and the position of the pelvis. The two chambers 4 and 5 communicate with one another. The rear chamber 4 has a length v and a maximum height w. The latter decreases towards the front of the seat cushion 3, i.e., in the direction of the adjacent chamber 5 to the lower height x, which slightly surpasses the greatest height of the front chamber 5, the height of which decreases toward the front to approximately the value y. In the unused, fully-inflated state of the seat cushion of the usual configuration, as normal, the height x is limited by the height of a crosspiece 9 connecting the groove of the top and the bottom, which can be provided with several perpendicular openings 14. The length z of the front chamber 5 is shorter than the length v of the rear chamber 4, which is also higher. The sitting area 6 forms a somewhat sloping plane having, however, the separating groove 7 separating the two chambers 4 and 5. If necessary, the chambers 4 and 5 can also be provided with a more or less pronounced longitudinal groove 8, which is indicated in dashed lines because it is only an alternative.

Figure 3:
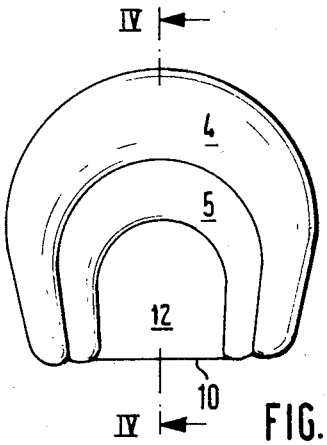
FIG. 3 is a top view a modified embodiment.
Figure 4:
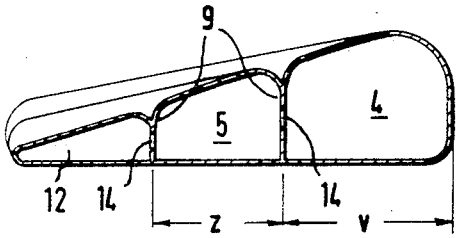
FIG. 4 is a cross-section view taken along the line IV—IV in FIG. 3.
Figure 2A:
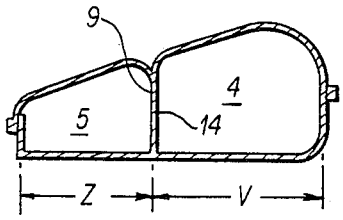
FIG. 2A is a cross-section view of FIG. 2.

Whereas in the embodiment according to FIG. 2 the two chambers 4 and 5 run parallel to each other, the chambers 4 and 5 of the cushion separated by crosspieces 9 with through openings 14, according to FIG. 3, have a general forwardly facing U-opening. The outer chamber 4 is again higher in the rear and towards the outside, and its height decreases towards the front, i.e., it decreases steadily in the direction of the front or inner chamber 5. Furthermore, the length v of the rear chamber 4 is greater than the length z of the front or inner chamber 5. The chamber 4 is led in a bow-shape around the chamber 5, whereby it can be recognized in FIG. 3. A third chamber 12 may be provided, as shown in FIG. 4.

Figure 4A:
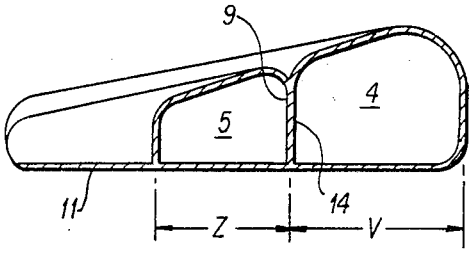
FIG. 4A is a view similar to FIG. 4 of a modified embodiment.

There is a marked difference of the widths v or z of the chambers 4 and 5 up to the front end of the front edge 10 of the seat cushion 3. The space 11 inside of the U-shaped chamber can be simply lined by a section of material as shown in FIG. 4A. It can, however, also consist of a further chamber 12, which is also lower than the adjacent chamber 5. This is represented in FIG. 4. 9 indicates a crosspiece wall for the division of the individual chambers, whereby 14 indicates openings which allow the air to pass between the chambers. Instead of the crosspiece wall 9, of course, the top and the bottom of the cushion could also be immediately connected by means of a fusion weld extending over the entire width.

I claim:

1. An inflatable seat cushion used as a posture aid and training comprising flexible material means forming a plurality of adjacently disposed and joined chambers, an outer surface of the cushion having an indented groove where the chambers are joined to one another, said plurality of chambers having a height which decreases from the rear towards the front, with the front corresponding to the front of a person seated in the cushion such that the cushion thereby slopes downwardly and forwardly, said chambers having a U-shaped configuration which includes two leg portions extending from a base portion, said base portion being at the rear of the cushion, each of said chambers having two halves determined by an imaginary vertical bisecting plane extending from front to rear, each of said chambers at said imaginary bisecting plane having a maximum vertical height, each of said chambers having closed ends at the terminating end of said leg portions, each of said chambers at said closed ends having a minimum vertical height, said chambers having a progressively decreasing vertical height extending from said maximum vertical height to said minimum vertical height, said chambers at said imaginary bisecting plane having maximum horizontal width, said chambers at said closed ends having a minimum horizontal width, said chambers having a decreasing horizontal width extending from said maximum horizontal width to said minimum horizontal width, one of said U-shaped chambers constituting an outer chamber and another of said U-shaped chambers constituting an inner chamber, said maximum vertical height of said outer U-shaped chamber being greater than the maximum vertical height of said inner U-shaped chamber, the maximum horizontal width of said outer U-shaped chamber being greater than the maximum horizontal width of said inner U-shaped chamber, each of said U-shaped chambers having a top and bottom wall, crosspiece wall means disposed between adjacent U-shaped chambers, said crosspiece wall means extending between said top and bottom walls, said crosspiece wall means having openings to provide communication between adjacent U-shaped chambers, said crosspiece wall means having a U-shaped cross-sectional configuration taken along an imaginary horizontal cutting plane, said indented groove having a U-shaped configuration, said crosspiece wall means having an upper terminating end which is coincident with said indented groove, whereby the seat cushion provides, as in upright walking, extensive free movement which thereby avoids stress and which activates the erecting muscular system, the seat cushion thereby being useful as an aid or training device especially for sitting upright without a back rest.

* * * * *